US008142004B2

(12) United States Patent
Kusunoki

(10) Patent No.: US 8,142,004 B2
(45) Date of Patent: Mar. 27, 2012

(54) IMAGE FORMING APPARATUS

(75) Inventor: Naoki Kusunoki, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 405 days.

(21) Appl. No.: 12/537,162

(22) Filed: Aug. 6, 2009

(65) Prior Publication Data

US 2010/0039461 A1 Feb. 18, 2010

(30) Foreign Application Priority Data

Aug. 13, 2008 (JP) ..... 2008-208639

(51) Int. Cl.

| | |
|---|---|
| ***B41J 2/01*** | (2006.01) |
| ***B05C 1/02*** | (2006.01) |
| ***B05C 5/00*** | (2006.01) |
| ***B05C 11/10*** | (2006.01) |

(52) U.S. Cl. ..... 347/96; 347/6; 347/84; 347/85; 347/89; 347/92; 347/93

(58) Field of Classification Search ..... 347/96, 347/92, 93, 89, 6, 84, 85
See application file for complete search history.

(56) References Cited

U.S. PATENT DOCUMENTS

| | | | | |
|---|---|---|---|---|
| 2005/0179720 | A1 | 8/2005 | Iwasaki et al. | |
| 2006/0279618 | A1 * | 12/2006 | Iwasaki et al. | 347/90 |
| 2007/0070163 | A1 * | 3/2007 | Masuyama et al. | 347/104 |
| 2008/0297573 | A1 | 12/2008 | Iwasaki et al. | |

FOREIGN PATENT DOCUMENTS

| | | |
|---|---|---|
| JP | 2005-225065 | 8/2005 |

* cited by examiner

*Primary Examiner* — Julian Huffman
(74) *Attorney, Agent, or Firm* — McGinn IP Law Group, PLLC

(57) ABSTRACT

An image forming apparatus includes: a treatment liquid application device which applies a treatment liquid to a recording medium; a treatment liquid supplying device which abuts against the treatment liquid application device so as to form a liquid holding space, fills the treatment liquid into the liquid holding space by use of a liquid delivery device which delivers the treatment liquid to the liquid holding space via a first flow channel from a treatment liquid reservoir storing the treatment liquid, and restores the treatment liquid to the treatment liquid reservoir via a second flow channel from the liquid holding space; a controller which controls at least one of a treatment liquid filling operation and a treatment liquid restoring operation with respect to the liquid holding space; an ink ejecting device which ejects a droplet of an ink onto the recording medium to which the treatment liquid application device has applied the treatment liquid; and an air bubble mixing avoidance device which is provided in the second flow channel and prevents air from discharging in the treatment liquid in the treatment liquid reservoir.

6 Claims, 10 Drawing Sheets

IMAGE FORMING APPARATUS

BACKGROUND OF THE INVENTION

1. Field of the Invention

The present invention relates to an image forming apparatus, and more particularly to liquid application technology that can be used desirably for depositing a treatment liquid on a recording medium prior to the deposition of an ink by means of an inkjet recording apparatus in order to promote aggregation of a color material of the ink, for example.

2. Description of the Related Art

In order to realize a high quality printing by an inkjet recording apparatus, the technology is known in which a treatment liquid, such as multivalent metal salt solution or acid aqueous solution, is deposited on a recording medium prior to depositing an ink thereon, so that the treatment liquid reacts with the ink on the recording medium so as to prevent the breeding or color mixture of the ink.

Japanese Patent Application Publication No. 2005-225065 discloses a liquid application apparatus comprising a mechanism depositing a treatment liquid on a recording medium. The mechanism includes: an application roller serving as an application member applying the treatment liquid to the recording medium; and a liquid holding member holding the application liquid in a liquid holding space which is formed by causing the liquid holding member to abut against the surface (roller surface) of the application roller. According to this liquid application apparatus, by rotating the application roller, the application liquid held in the liquid holding space is supplied to the surface of the application roller while the application liquid is transferred from the application roller to the recording medium.

In this liquid application apparatus, when it is determined that an application operation is not carried out for some time after the end of the previous application operation, then the application liquid is restored from the liquid holding space so as to prevent the application roller from being immersed in the application liquid for a long time and reduce the deterioration of the application roller caused by the application liquid.

However, according to the liquid application apparatus disclosed in Japanese Patent Application Publication No. 2005-225065, a restore flow channel (second flow channel) for restoring the treatment liquid in the liquid holding space to a storage tank is opened into the treatment liquid layer of the storage tank (i.e. below the liquid surface of the treatment liquid). Therefore, when the treatment liquid restoring operation is carried out for the liquid holding space, the treatment liquid is sent to the treatment liquid layer of the storage tank at the initial phase, and then the air trapped via an air connection port that is connected with a supply flow channel (first flow channel) is sent to the treatment liquid layer of the storage tank together with the treatment liquid from the middle phase to the end phase. In this way, the air is trapped in and mixed with the treatment liquid in the storage tank, thereby oxidizing the treatment liquid in the storage tank. As a result of the oxidation of the treatment liquid, the aggregation of the ink based on the reaction with the treatment liquid becomes insufficient, and it becomes difficult to prevent the breeding or color mixture of the ink sufficiently.

Moreover, similar phenomena can occur during the filling operation of the treatment liquid into the liquid holding space. More specifically, during the filling operation, until the treatment liquid is filled into the liquid holding space and the flow channels, the air existing in parts thereof is sent into the treatment liquid layer of the storage tank. Therefore, as in the case of the filling operation, the air is trapped in and mixed with the treatment liquid in the storage tank, thereby oxidizing the treatment liquid in the storage tank. In particular, the progression of the oxidation of the treatment liquid is more rapid during the filling operation than that during the restoring operation, which can lead to noticeable phenomena.

SUMMARY OF THE INVENTION

The present invention has been contrived in view of these circumstances, an object thereof being to provide an image forming apparatus which can prevent the oxidation of a treatment liquid accompanied by the filling operation and restoring operation of the treatment liquid.

In order to attain an object described above, one aspect of the present invention is directed to an image forming apparatus comprising: a treatment liquid application device which applies a treatment liquid to a recording medium; a treatment liquid supplying device which abuts against the treatment liquid application device so as to form a liquid holding space, fills the treatment liquid into the liquid holding space by use of a liquid delivery device which delivers the treatment liquid to the liquid holding space via a first flow channel from a treatment liquid reservoir storing the treatment liquid, and restores the treatment liquid to the treatment liquid reservoir via a second flow channel from the liquid holding space; a controller which controls at least one of a treatment liquid filling operation and a treatment liquid restoring operation with respect to the liquid holding space; an ink ejecting device which ejects a droplet of an ink onto the recording medium to which the treatment liquid application device has applied the treatment liquid; and an air bubble mixing avoidance device which is provided in the second flow channel and prevents air from discharging in the treatment liquid in the treatment liquid reservoir.

According to this aspect of the invention, an air bubble mixing avoidance device is provided in a second flow channel via which a treatment liquid is restored from a liquid holding space to a treatment liquid reservoir, which can prevent air bubbles from mixing into the treatment liquid in the treatment liquid reservoir and can suppress the oxidation of the treatment liquid in the treatment liquid reservoir during the filling operation and restoring operation of the treatment liquid for the liquid holding space. As a result, an ink can be sufficiently aggregated by reacting with the treatment liquid, the breeding and color mixture of the ink can be fully prevented, and the image quality can be improved.

The "recording medium" collectively means media which the application of a treatment liquid is subject to, and can represent printing media, media on which an image is formed, media on which recording is performed, media on which a picture/image is received, media on which ejection is received and intermediate transfer bodies. The shape and material of the medium is not limited in particular, and the recording medium can represent, regardless of the material or shape thereof, a variety of media, such as continuous papers, cut papers, sealed papers, sticker sheets, resin sheets for overhead projectors and the like, films, cloths, printed circuit boards on which wiring pattern or the like can be formed, rubber sheets and metal sheets.

Further, the "image forming apparatus" is not in particular limited to devices for the so-called graphic printing such as a photo printing or poster printing, and collectively means devices which include industry application devices that can form patterns which can be classified as an image, such as resist printing apparatuses, wiring forming apparatuses for electronic circuit substrates and apparatuses that form fine structural objects, for example.

Desirably, the treatment liquid reservoir has an air connection port formed with an air connection valve; the first flow channel is formed with a three way valve which enables the first flow channel to be open to air; the second flow channel has an opening situated below a surface of the treatment liquid in the treatment liquid reservoir; and the air bubble mixing avoidance device has a third flow channel which branches off from the second flow channel, an air vent valve which is able to open and close the third flow channel, and an opening situated above the surface of the treatment liquid in the treatment liquid reservoir.

Desirably, when filling the treatment liquid into the liquid holding space, the controller switches the air vent valve from an open condition to a closed condition at a first timing. In particular, desirably, the first timing is set according to volume of the liquid holding space, volume of the first flow channel, volume of the second flow channel and performance of the liquid delivery device. In these cases, when the treatment liquid is filled into the liquid holding space, the oxidation caused by the mixture of air bubbles into the treatment liquid in the treatment liquid reservoir is prevented more reliably.

Desirably, when restoring the treatment liquid from the liquid holding space, the controller switches the air vent valve from a closed condition to an open condition at a second timing. In particular, desirably, the second timing is set according to volume of the liquid holding space, volume of a portion of the first flow channel which is closer to the liquid holding space than the three way valve, volume of the second flow channel and performance of the liquid delivery device. In these cases, when the treatment liquid is restored from the liquid holding space, the oxidation due to the mixture of air bubbles into the treatment liquid in the treatment liquid reservoir is prevented more reliably.

According to aspects of the present invention, by providing an air bubble mixing avoidance device in a second flow channel used for restoring a treatment liquid from a liquid holding space to a treatment liquid reservoir, air bubbles are prevented from mixing with the treatment liquid in the treatment liquid reservoir when the filling operation or the restoring operation of the treatment liquid is carried out with respect to the liquid holding space, thereby preventing the oxidation of the treatment liquid in the treatment liquid reservoir. As a result, an ink can be sufficiently aggregated by reacting with the treatment liquid, the breeding and color mixture of the ink can be prevented, and the image quality can be improved.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Inkjet Recording Apparatus

Firstly, an inkjet recording apparatus which is one embodiment of an image forming apparatus relating to the present invention will be described.

Figure 1:
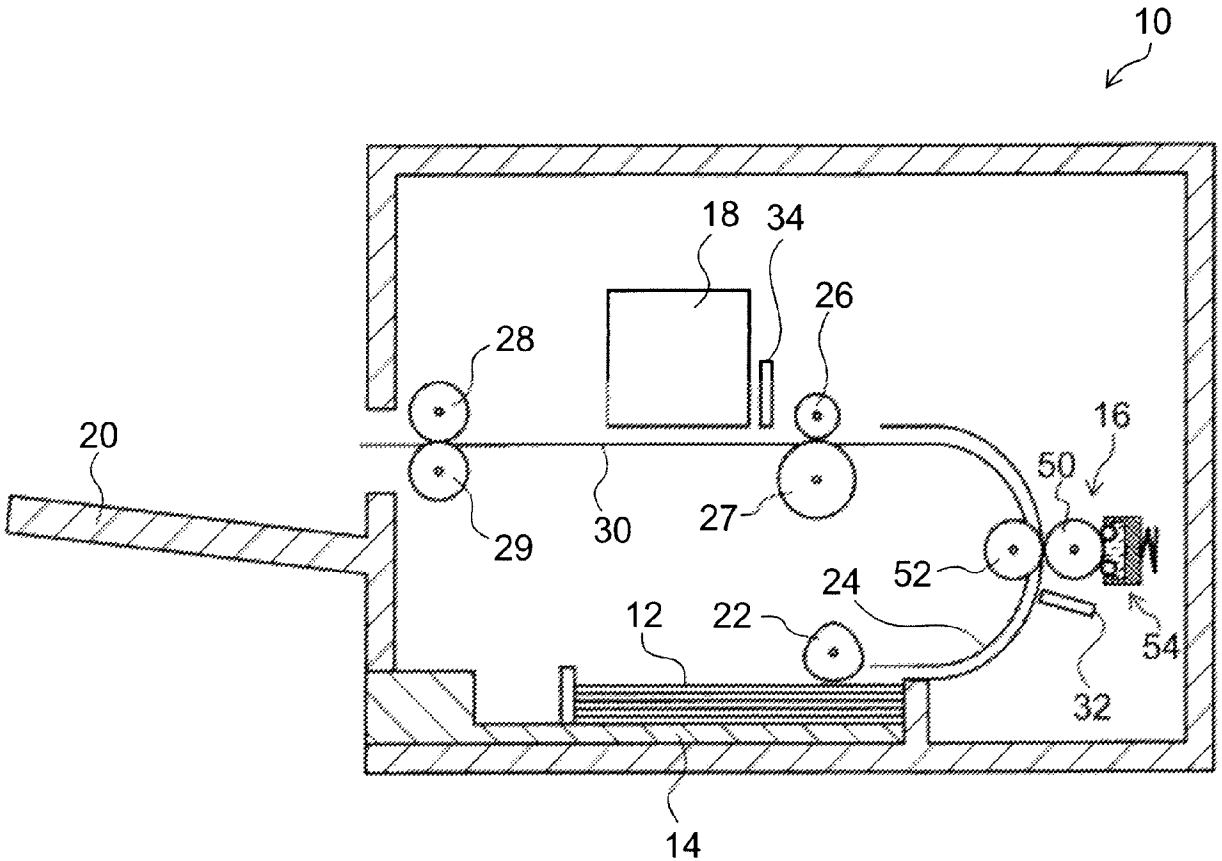
FIG. 1 is a general schematic drawing illustrating an approximate view of an inkjet recording apparatus relating to one embodiment of the present invention.

FIG. 1 is a schematic drawing illustrating an overview of an inkjet recording apparatus relating to the present embodiment. As illustrated in FIG. 1, the inkjet recording apparatus 10 comprises: a paper supply unit 14 which supplies a recording medium 12; a treatment liquid application unit 16 which applies treatment liquid to the recording medium 12 supplied from the paper supply unit 14; an ink droplet ejection unit 18 which ejects droplets of ink onto the recording medium 12 after the deposition of treatment liquid; and an output tray 20 which outputs the recording medium 12 onto which an image has been formed by the ink droplet ejection unit 18.

The paper supply unit 14 employs a method based on a paper supply cassette in which a plurality of sheets of recording media 12 cut to a prescribed size are loaded. It is also possible to provide a plurality of paper supply cassettes in such a manner that papers of a plurality of different sizes can be supplied. Furthermore, it is also possible to adopt a mode in which rolled paper (continuous paper) is used instead of cut sheet, and the rolled paper is cut to an appropriate size by a cutter.

The treatment liquid application unit 16 comprises a treatment liquid application device which applies treatment liquid to a recording medium 12, and a treatment liquid supply device which supplies the treatment liquid to the treatment liquid application device.

The treatment liquid application device is constituted by a round cylindrical application roller 50 forming an application member, a round cylindrical counter roller (medium supporting member) 52 which is disposed so as to oppose the application roller 50, and a roller drive mechanism (not illustrated) which drives the application roller 50, and the like. The application roller 50 and the counter roller 52 are respectively supported rotatably by mutually parallel axes of which the respective ends are installed rotatably on a frame (not illustrated).

The treatment liquid supply device comprises: a liquid holding member 54 which holds the treatment liquid between the liquid holding member 54 and the circumferential surface of the application roller 50, and a liquid supply apparatus (not illustrated) which supplies the treatment liquid to the liquid holding member 54. The liquid holding member 54 extends through the lengthwise direction of the application roller 50 and is installed movably on the aforementioned frame via a mechanism which enables separation from the circumferential surface of the application roller 50.

The ink droplet ejection unit 18 is provided on the downstream side of the treatment liquid application unit 16 in terms of the direction of conveyance of the medium. The ink droplet ejection unit 18 according to the present example is constituted by recording heads of an inkjet type which correspond respectively to inks of four colors of yellow (Y), magenta (M), cyan (C) and black (K). Although not illustrated in the drawings, inks of the corresponding colors are supplied respectively to the recording heads of the respective colors, from ink tanks which are not illustrated.

The recording heads of the respective colors in the ink droplet ejection unit 18 are each heads of a full line type which respectively have a length corresponding to the maximum width of the image forming region on the recording medium 12 and comprise a plurality of ink ejection nozzles arranged through the full width of the image forming region on the ink ejection surface of the head.

The recording heads of the respective colors are fixed so as to extend in a direction perpendicular to the direction of conveyance of the recording medium 12 (the direction perpendicular to the plane of the drawing in FIG. 1), and respectively eject liquid droplets of the corresponding colored ink onto the recording medium 12 on the platen 30.

In this way, according to a composition in which full line heads having nozzle rows covering the full width of the image forming region of the recording medium 12 are provided for each color of ink, it is possible to record an image on the image forming region of the recording medium 12 by performing just one operation of moving the recording medium 12 and the recording head relatively with respect to each other in the direction of conveyance of the recording medium 12 (the sub-scanning direction), in other words, by performing just one sub-scanning.

It is also possible to adopt a mode which employs, instead of full line heads, heads of a serial (shuttle) type which move reciprocally back and forth in a direction (main scanning direction) perpendicular to the direction of conveyance of the recording medium 12 (sub-scanning direction), but forming an image by a single pass method using heads of a full line type (page-wide heads) enables faster printing than a multi-pass method using serial (shuttle) type heads, and therefore the print productivity can be improved.

Although the configuration with the CMYK four colors is described in the present embodiment, combinations of the ink colors and the number of colors are not limited to those. Light inks, dark inks or special color inks can be added as required. For example, a configuration is possible in which recording heads for ejecting light-colored inks such as light cyan and light magenta are added. Furthermore, there are no particular restrictions of the sequence in which the heads of respective colors are arranged.

Possible examples of the ink used in the inkjet recording apparatus 10 according to the present embodiment include a dye-based ink in which a coloring material is dissolved in a molecular state (an ionic state is also possible) in the solvent of the liquid, and a pigment-based ink in which a coloring material is dispersed in the solvent of the liquid in a state of small particles.

On the other hand, the treatment liquid is a liquid which generates an aggregate of the coloring material when mixed with an ink. Specific examples of the treatment liquid include a treatment liquid which precipitates or insolubilizes the coloring material in the ink by reacting with the ink, and a treatment liquid which generates a semi-solid material (gel) that includes the coloring material in the ink, and the like.

The means of generating a reaction between the ink and the treatment liquid may be a method which causes an anionic coloring material in the ink with a cationic compound in the treatment liquid, a method which aggregates pigment by breaking down the dispersion of the pigment in the ink due to altering the pH of the ink by mixing an ink and a treatment liquid which have different pH values, a method which aggregates pigment by breaking down the dispersion of the pigment in the ink due to a reaction with a polyvalent metal salt in the treatment liquid, or the like.

For instance, examples of a treatment liquid having an action of aggregating the coloring material contained in ink which is ejected as droplets from the ink droplet ejection unit 18 according to the present embodiment are aggregating treatment agents, such as a polyvalent metal salt, polyallylamine, a polyallylamine derivative, an acidic liquid, a cationic surfactant, and the like. By promoting the aggregation of the coloring material on the recording medium 12 by means of a treatment liquid of this kind, it is possible to improve the recording density as well as reducing or preventing bleeding.

Examples of the composition of the treatment liquid (treatment liquid A, treatment liquid B) are described below.

Treatment Liquid A

Malonic acid: 15%;

Diethylene glycol monomethyl ether (Wako Pure Chemical Industries, Ltd.): 20%; and Deionized water: 65%

Treatment Liquid B

Calcium nitrate: 15%;

Diethylene glycol monomethyl ether (Wako Pure Chemical Industries, Ltd.): 20%; and Deionized water: 65%

According to this composition, recording media 12 which are loaded in the paper supply unit 14 are supplied to the conveyance path 24 repeatedly, one sheet at a time, by the paper supply roller 22. When a recording medium 12 which has been supplied to the conveyance path 24 from the paper supply unit 14 is fed between the rollers 50 and 52, then the treatment liquid is applied to the recording surface of the recording medium 12 while the application roller 50 is rotated in the clockwise direction in FIG. 1 by the roller drive mechanism and thereby conveys the recording medium 12.

The recording medium 12 onto which the treatment liquid has been applied is conveyed onto a platen 30 by a pair of conveyance rollers 26, 27, moved to a position opposing the ink droplet ejection unit 18, and ink droplets are ejected onto the recording surface of the recording medium 12 from the nozzles of the recording head.

The recording medium 12 on which an image has been formed in this way is output to an output tray 20 by a pair of output rollers 28 and 29.

Medium leading edge determination sensors 32 and 34 which determine the leading edge of the recording medium 12 are disposed in the conveyance path 24 for the recording medium 12. The first medium leading edge determination sensor 32 is disposed in the vicinity of the input to the application roller 50 on the paper supply side. The second medium leading edge determination sensor 34 is disposed in the vicinity of the input to the ink droplet ejection unit 18 on the paper supply side.

The treatment liquid application timing and the ink droplet ejection timing are controlled by determining the position of the recording medium 12 by means of these sensors (32, 34).

Next, the composition of the treatment liquid application unit 16 will be described in detail.

Figure 2:
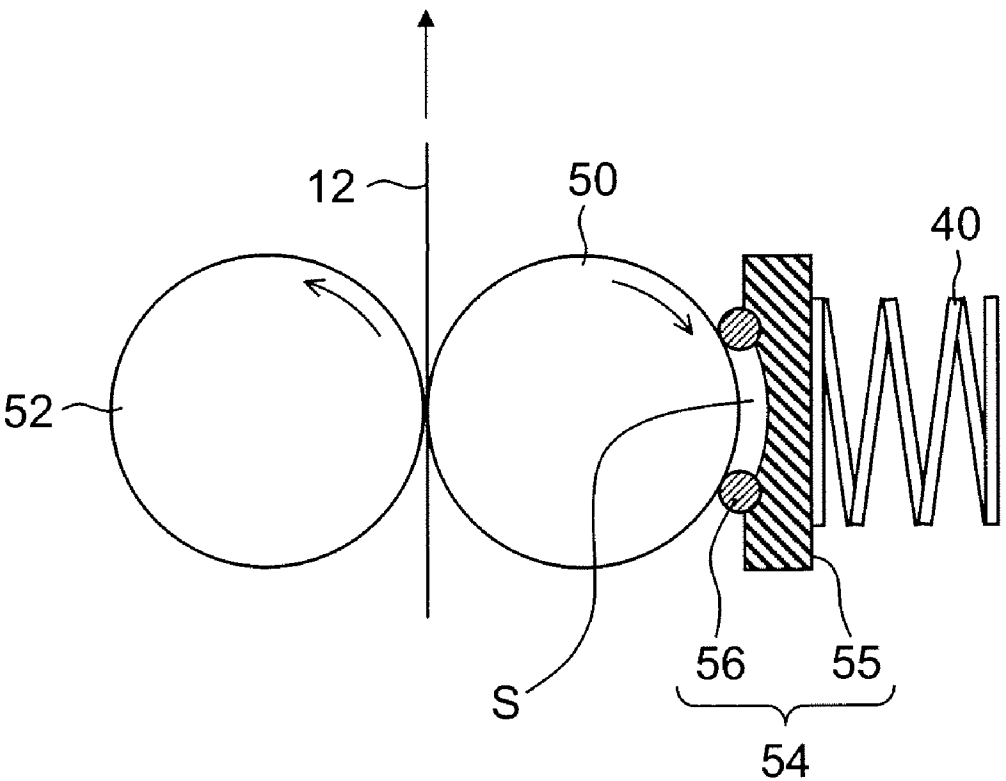
FIG. 2 is a cross-sectional diagram illustrating the composition of a treatment liquid application unit.
Figure 3:
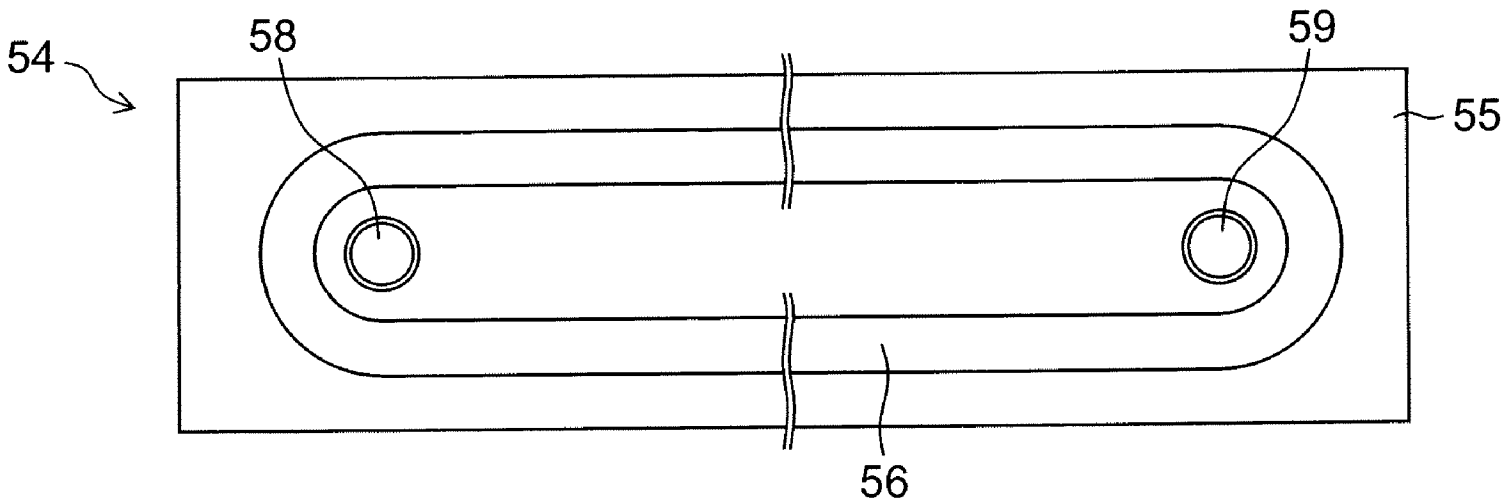
FIG. 3 is a plan diagram illustrating the composition of a liquid holding member.

FIG. 2 is a cross-sectional diagram illustrating the composition of the treatment liquid application unit 16. FIG. 3 is a plan diagram illustrating the composition of the liquid holding member 54.

The counter roller 52 is impelled toward the circumferential surface of the application roller 50 by an impelling device (not illustrated), and by rotating the application roller 50 in the clockwise direction in FIG. 2, the recording medium 12 is conveyed in the direction of the arrow in FIG. 2 while the recording medium 12 to which the treatment liquid is to be applied is gripped between the two rollers.

Furthermore, a spring member 40 is provided on the rear surface side of the liquid holding member 54 which constitutes the liquid supply device, and the liquid holding member 54 is impelled toward the circumferential surface of the application roller 50 by the impelling force of the spring member 40. The liquid holding member 54 is constituted by a space forming base member 55, and a ring-shaped abutting member 56 which is provided in a projecting manner on one surface of the space forming base member 55. By this means, in a state where the abutting member 56 of the liquid holding member 54 is abutted (in tight contact) so as to press against the circumferential surface of the application roller 50, a liquid holding space S is formed which is sealed off (hermetically closed) by the abutting member 56, one surface of the space forming base member 55, and the circumferential surface of the application roller 50.

A liquid supply port 58 and a liquid return port 59 formed so as to pass through the space forming base member 55 are provided in the region of the liquid holding member 54 which is surrounded by the abutting member 56. During the printing operation (in other words, during an application operation), the treatment liquid is supplied from the liquid supply apparatus, which is described hereinafter, via the liquid supply port 58, and the treatment liquid is held in the liquid holding space S, in addition to which the treatment liquid flows inside the liquid holding space S and the treatment liquid is returned in the liquid supply apparatus via the liquid return port 59.

Figure 4:
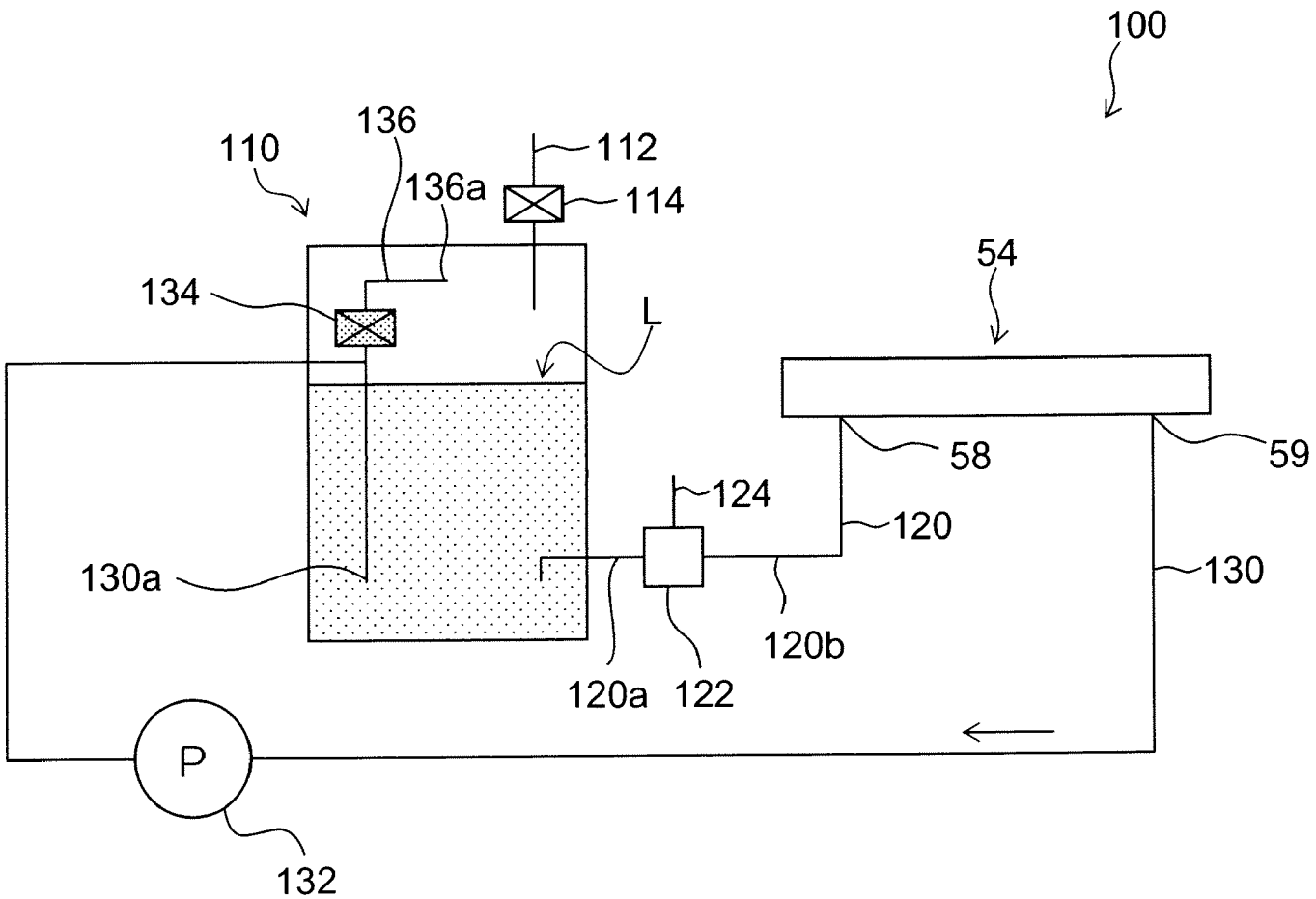
FIG. 4 is a schematic drawing illustrating an example of the composition of a liquid supply apparatus which is connected to the liquid holding member.

FIG. 4 is a schematic drawing illustrating an example of the composition of a liquid supply apparatus which is connected to the liquid holding member 54. As illustrated in FIG. 4, the liquid supply apparatus 100 comprises a storage tank 110 which stores the treatment liquid, a supply flow channel 120 for supplying the treatment liquid to the liquid supply port 58 of the liquid holding member 54 from the storage tank 110, and a return flow channel 130 for returning the treatment liquid to the storage tank 110 from the liquid return port 59 of the liquid holding member 54.

An air connection port 112 is provided in the storage tank 110, and an air connection valve 114 which switches between connecting to and shutting off the air is provided in the air connection port 112.

One end of the supply flow channel 120 is connected to the liquid supply port 58 of the liquid holding member 54, and the other end thereof is connected to the interior of the liquid layer in the storage tank 110 (a position below the surface L of the treatment liquid).

A three way valve 122 is provided in the supply flow channel 120. This three way valve 122 has three ports which are mutually connected, and two of these ports can be connected selectively to any two of the storage tank side flow channel 120*a* of the supply flow channel 120, the liquid holding member side flow channel 120*b* of the supply flow channel 120, and the air connection port 124. By switching this three way valve 122, it is possible to switch selectively between a connected state where the storage tank side flow channel 120*a* and the liquid holding member side flow channel 120*b* are connected (hereinafter, simply called a "connected state") and a connected state where the liquid holding member side flow channel 120*b* and the air connection port 124 are connected (hereinafter called an "air connected state"), and thereby it is possible to supply either the treatment liquid inside the storage tank 110 or air taken in via the air connection port 124, to the liquid holding space S formed by the liquid holding member 54 and the application roller 50.

A pump 132 is provided in the return flow channel 130. This pump 132 generates a flow which forcibly causes the liquid or air to move in the direction of the arrow in FIG. 4.

One end of the return flow channel 130 is connected to the liquid return port 59 of the liquid holding member 54, and the other end thereof is connected to the liquid layer in the storage tank 110 (a position below the surface L of the treatment liquid). In other words, the position of the opening of the return flow channel 130 is below the surface L of the treatment liquid in the storage tank 110.

Furthermore, inside the storage tank 110, a gas expulsion flow channel 136 (which corresponds to the "air bubble mixing avoidance device" of the present invention) having an air vent valve 134 branches from the return flow channel 130. This air expulsion flow channel 136 is composed so as to open in the gas layer in the storage tank 110 (namely, at a position above the surface L of the treatment liquid). In other words, the position of the opening of the gas expulsion flow channel 136 is above the surface L of the treatment liquid in the storage tank 110. In the present embodiment, the position at which the gas expulsion flow channel 136 branches from the return flow channel 130 is a position inside the storage tank 110, but the invention is not limited to this and it is of course also possible for this position to be outside the storage tank 110.

The air vent valve 134 which switches between connecting to or shutting off the gas layer in the storage tank 110 is provided in the gas expulsion flow channel 136, and as described below, in the operation of filling treatment liquid and the operation of returning treatment liquid, the air vent valve 134 is opened and closed, thereby making it possible to expel the air sent to the storage tank 110 from the liquid holding space S, or the like, into the gas layer (air reservoir) inside the storage tank 110, without being expelled into the treatment liquid, and therefore oxidation of the treatment liquid in the storage tank 110 can be prevented.

Figure 5:
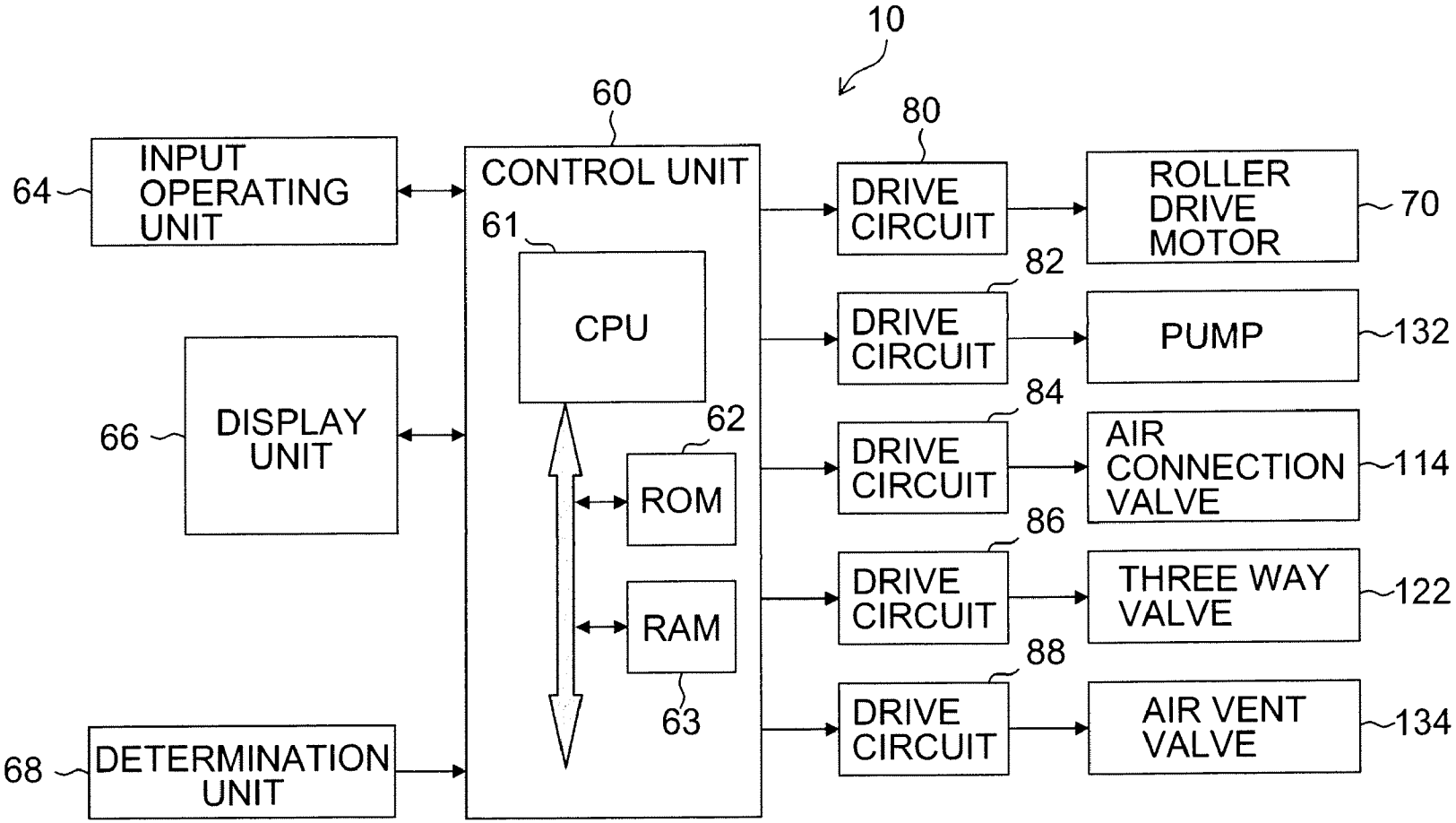
FIG. 5 is a block diagram illustrating the composition of the control system of a liquid application apparatus.

FIG. 5 is a block diagram illustrating the composition of the control system of an inkjet recording apparatus 10 according to the present embodiment.

In FIG. 5, the control section 60 (which is equivalent to a "drive control device") is a control device which performs overall control of the whole of the inkjet recording apparatus 10. The control unit 60 comprises: a CPU (Central Processing Unit) 61 which executes processing of various types in accordance with prescribed programs; a ROM (Read Only Memory) 62 which stores programs, data of various types, and the like; and a RAM (Random Access Memory) 63 which temporarily stores data, and the like, that are used in the various types of processing.

The input operating unit 64 is constituted, for example, by a keyboard or mouse (or various switches, or the like) which is used to input prescribed instructions or data. The display unit 66 constitutes a user interface together with the input operating unit 64 and provides various displays in conjunction with the control unit 60. For example, the display unit 66 is constituted by a liquid display apparatus.

Furthermore, the inkjet recording apparatus 10 comprises a determination unit 68 which includes a sensor (medium size determination sensor) for determining the width size of the recording medium 12 (see FIG. 1) (the size in the breadthways direction which is perpendicular to the medium conveyance direction), a sensor (medium position determination sensor) for determining the position of the medium, and in addition to these, a sensor which determines the operational states of the respective units, and the like. The signals from the determination unit 68 are sent to the control unit 60, and are used to drive the roller and control other operations. The determination unit 68 includes the medium leading edge determination sensors 32, 34.

Furthermore, the inkjet recording apparatus 10 comprises a roller drive motor 70 which drives the application roller 50 (see FIG. 1), the pump 132 (see FIG. 5), the air connection valve 114, a three way valve 122, an air vent valve 134 and drive circuits 80, 82, 84, 86 and 88 corresponding to these respective elements; and the control unit 60 sends control signals to the respective drive circuits 80 to 88 in accordance with programs, and thereby controls the operation of the respective elements.

Figure 6:
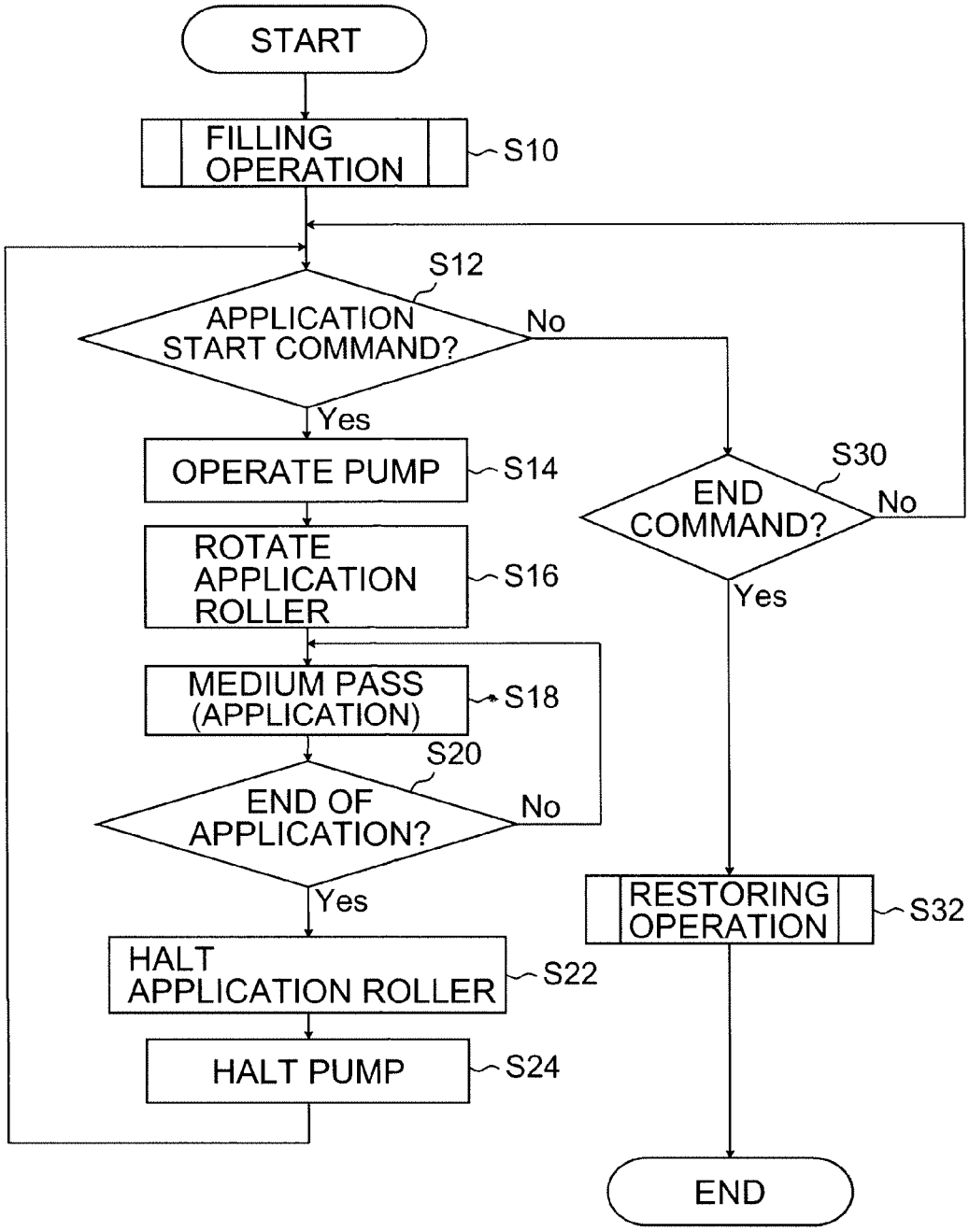
FIG. 6 is a flowchart illustrating the operational sequence of a liquid application apparatus.

FIG. 6 is a flowchart illustrating the operational sequence of the inkjet recording apparatus 10. These operations are executed in accordance with programs, under the control of the control unit 60 illustrated in FIG. 5. In the initial state at the start of this sequence, it is supposed that the liquid holding space S and the flow channels 120 and 130 are not filled with the treatment liquid.

Firstly, when the power supply of the liquid application apparatus is switched on, the filling operation (supply operation) for filling the treatment liquid into the liquid holding space S is carried out (step S10).

Figure 7:
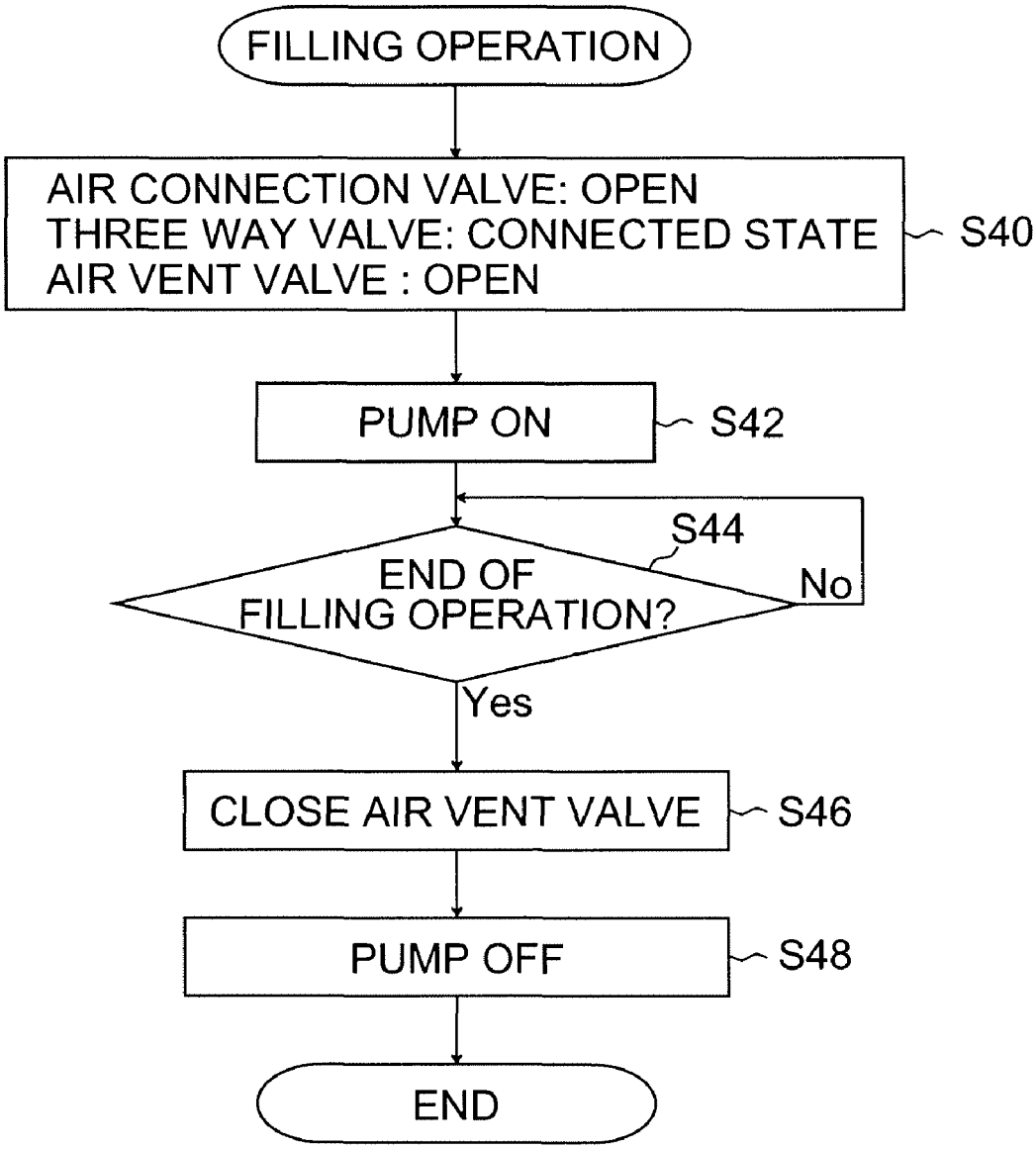
FIG. 7 is a flowchart illustrating the details of a filling operation.

Here, the filling operation is described in detail with reference to FIG. 7. FIG. 7 is a flowchart illustrating details of the filing operation. In this filling operation, firstly, the air connection valve 114 of the storage tank 110 is opened, and the three way valve 122 is switched to set the supply flow channel 120 to a connected state (a state where the storage tank side flow channel 120*a* and the liquid holding member side flow channel 120*b* are connected), and furthermore the air vent valve 134 is set to an open state (step S40). Thereupon, the driving of the pump 132 is started (switched on) (step S42). By this means, the air present in the liquid holding space S and the flow channels 120 and 130 is supplied to the storage tank 110 and the treatment liquid is filled into the respective sections.

In this case, since the air vent valve 134 of the gas expulsion flow channel 136 is in an open state, then the air supplied to the storage tank 110 is not expelled into the treatment liquid layer from the return flow channel 130, but rather is expelled via the gas expulsion flow channel 136 to the gas layer in the storage tank 110 (the space above the surface L of the treatment liquid).

Next, the end timing of the filling operation is judged (step S44). The judgment at step S44 is No until the end timing of the filling operation, and the driving of the pump 132 is continued. When the end timing of the filling operation is reached, the judgment in step S44 becomes Yes, the air vent valve 134 is closed (step S46), and the driving of the pump 132 is halted (switched off) (step S48).

In this way, the treatment liquid is filled into the liquid holding space S and the flow channels 120 and 130, and a state is assumed whereby the treatment liquid can be supplied to the application roller 50 which is in contact with the liquid holding space S.

At step S44 illustrated in FIG. 7, the end timing of the filling operation is set as the timing at which all of the air present in the liquid holding space S and the flow channels 120 and 130 has been expelled. For example, a desirable mode is one in which a timer device that counts the drive time of the pump 132 is provided, and the end timing of the filling operation is judged on the basis of time management using the timer device.

Desirably, the time until all of the air in the respective sections is expelled is calculated or determined in advance experimentally on the basis of the volume of the liquid holding space S and the flow channels 120 and 130, and the capacity of the pump 132, and the timing of the end of this time period is set as the end timing of the filling operation described above.

In the mode described above, when the air has been expelled completely, the treatment liquid may momentarily spill over from the opening section 136*a* of the gas expulsion flow channel 136. Therefore, from the viewpoint of preventing soiling of the air vent valve 134, as illustrated in FIG. 4 it is desirable that the opening section 136*a* of the gas expulsion flow channel 136 should be disposed at a position separated from the position directly above the air vent valve 134. In other words, a desirable mode is one in which the opening section 136*a* of the gas expulsion flow channel 136 is vertically above the air vent valve 134 and is disposed so as not to be superimposed mutually in the vertical direction (i.e. in terms of the vertical direction, the opening section 136*a* and the air vent valve 134 are not aligned).

Furthermore, it is also possible to close the air vent valve 134 at a timing slightly earlier than the timing at which the air present in the liquid holding space S and the flow channels 120 and 130 is expelled completely. In this case, the air is expelled from the opening section 130*a* of the return flow channel 130 into the treatment liquid layer of the storage tank 110, but the amount of oxidation of the treatment liquid is not problematic if the amount of time is short.

Supposing that the air vent valve 134 and the gas expulsion flow channel 136 (in other words, the air bubble mixing avoidance device) is not provided, and that the opening section 130*a* of the return flow channel 130 is disposed above the surface L of the treatment liquid in the storage tank 110, then an effect of spraying air (air bubbles) into the treatment liquid does not occur, but if the treatment liquid which is expelled from the return flow channel 130 drips down onto the surface L of the treatment liquid, air is incorporated into the liquid and the problem of oxidation of the treatment liquid is difficult to resolve.

After the filling operation has been carried out in this way, the presence or absence of an application start command is judged (step S12 in FIG. 6). An application start command signal is issued in coordination with the conveyance of the recording medium 12. The application start command signal is issued at a prescribed time differential in such a manner that the application of treatment liquid starts at the timing that the recording medium 12 arrives at the nip section between the application roller 50 and the counter roller 52.

When the application start command is input and a Yes verdict is obtained at step S12, then the pump 132 is operated (step S14), and furthermore the roller driving is started to rotate the application roller 50 in the clockwise direction in FIG. 1 (step S16).

By this means, the treatment liquid held in the liquid holding space S is impelled by the pressing force of the abutting member 56 of the liquid holding member 54 against the 1o application roller 50, and thereby a layer of treatment liquid is formed on the outer circumferential surface of the application roller 50. The treatment liquid which has adhered to the outer circumferential surface of the application roller 50 is supplied to the abutting section with the counter roller 52 due to the rotation of the application roller 50.

Thereupon, the recording medium 12 is conveyed between the application roller 50 and the counter roller 52 by the medium conveyance mechanism, the recording medium 12 is introduced between the rollers 50 and 52, and furthermore the recording medium 12 is conveyed toward the paper output unit due to the rotation of the application roller 50 and the counter roller 52. The treatment liquid which has been applied to the outer circumferential surface of the application roller 50 is transferred to the recording medium 12 during this conveyance process (step S18).

Figure 8:
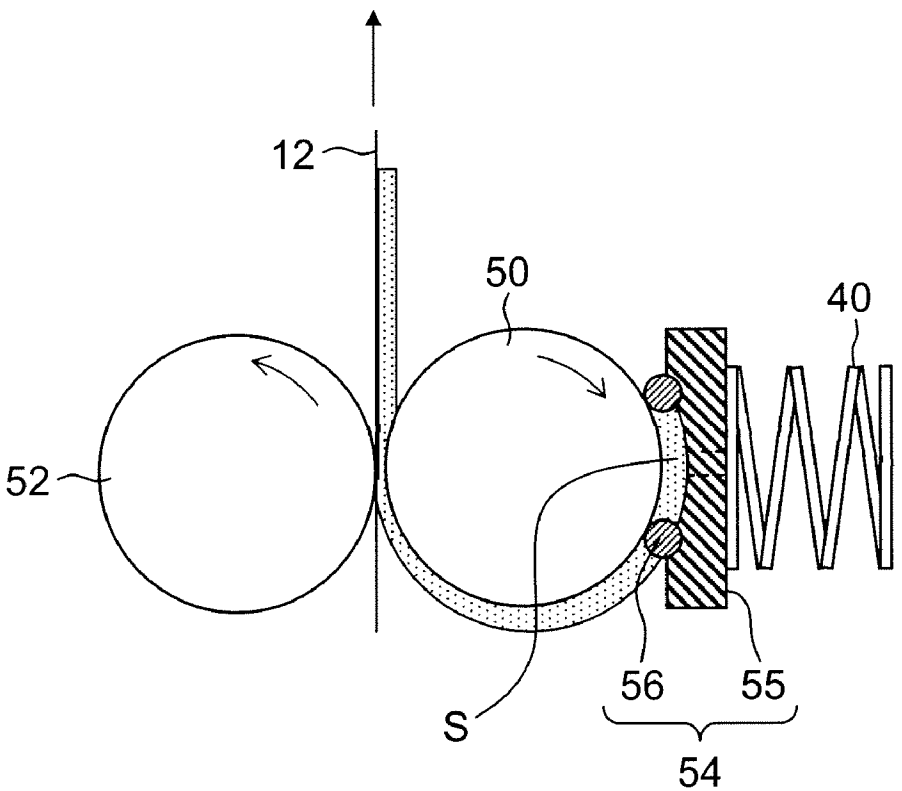
FIG. 8 is an illustrative diagram illustrating an aspect of a treatment liquid application step.

FIG. 8 illustrates an aspect of the application step in step S18. The thickness of the treatment liquid layer in FIG. 8 is depicted in an exaggerated fashion to be much larger than its actual size ratio. As illustrated in FIG. 8, the recording medium 12 which is sandwiched between the application roller 50 and the counter roller 52 is conveyed in the direction of the arrow in FIG. 8 due to the rotational force of the application roller 50, and furthermore the treatment liquid supplied to the outer circumferential surface of the application roller 50 is applied to the recording medium 12. In this way, treatment liquid of a uniform volume has been deposited onto the recording surface of the recording medium 12 which has passed between the application roller 50 and the counter roller 52.

In order to improve the transfer characteristics of the treatment liquid from the application roller 50 to the recording medium 12, it is desirable that the surface free energy of the application roller 50 should be lower than the surface free energy of the recording medium 12. In other words, a material which satisfies the inequality relationship indicated in Formula (1) below is employed as the surface member of the application roller 50.

$$\text{Surface free energy of application roller 50} < \text{Surface free energy of recording medium} \qquad \text{Formula (1)}$$

When the application operation onto the recording medium 12 described above has been carried out, the control unit 60 judges the end timing of the application operation (step S20 in FIG. 6). If liquid is applied to the whole surface of the recording medium 12, then the judgment at step S20 produces a No verdict and returns to step S18, until the recording medium 12 has passed completely.

If it is judged that the application step in the required application range has been completed (Yes verdict at step S20), for instance, the timing of the passage of the trailing edge of the recording medium 12 is detected or the end of a job of a specified number of sheets is detected, then the application roller 50 is halted (step S22), the pump 132 is halted (step S24) and the procedure returns to step S12.

The surface of the counter roller 52 has high lyophobic properties, by means of a fluorine coating for example, and is composed in such a manner that treatment liquid does not become attached readily to the surface of the counter roller 52 due to contact between the application roller 50 and the counter roller 52. By suitably designing the relationship of the free surface energy between the surface members of the both rollers, it is possible to prevent treatment liquid from becoming attached to the counter roller 52. Furthermore, a desirable mode is one in which a movement mechanism which is capable of altering the relative distance between the application roller 50 and the counter roller 52 is provided in at least one of the application roller 50 and the counter roller 52, and if it is judged that the application operation has been completed at step S20, then the adherence of treatment liquid to the surface of the counter roller 52 is prevented by setting the rollers to a mutually separated state.

At step S12, if a new application start command is input, then the processing in step S14 to step S24 described above is repeated. On the other hand, if at step S12 the application start command has not been input, then the procedure advances to step S30, and it is judged whether or not there is an application end command (step S30). The end command may be issued in accordance with various modes, such as a mode where an end command is issued automatically when a specified wait time has elapsed on the basis of time management using a timer, or the like, a mode where an end command is issued when application onto a specified number of sheets of media has been completed, a mode based on an operation from the input operating unit 64, or a mode based on a switching off operation of the apparatus power supply, or the like.

If an end command has not been input, then the procedure returns to step S12. If an end command has been input at step S30, then the return operation (restoring operation) of returning (restoring) the treatment liquid inside the liquid holding space S is carried out (step S32).

Figure 9:
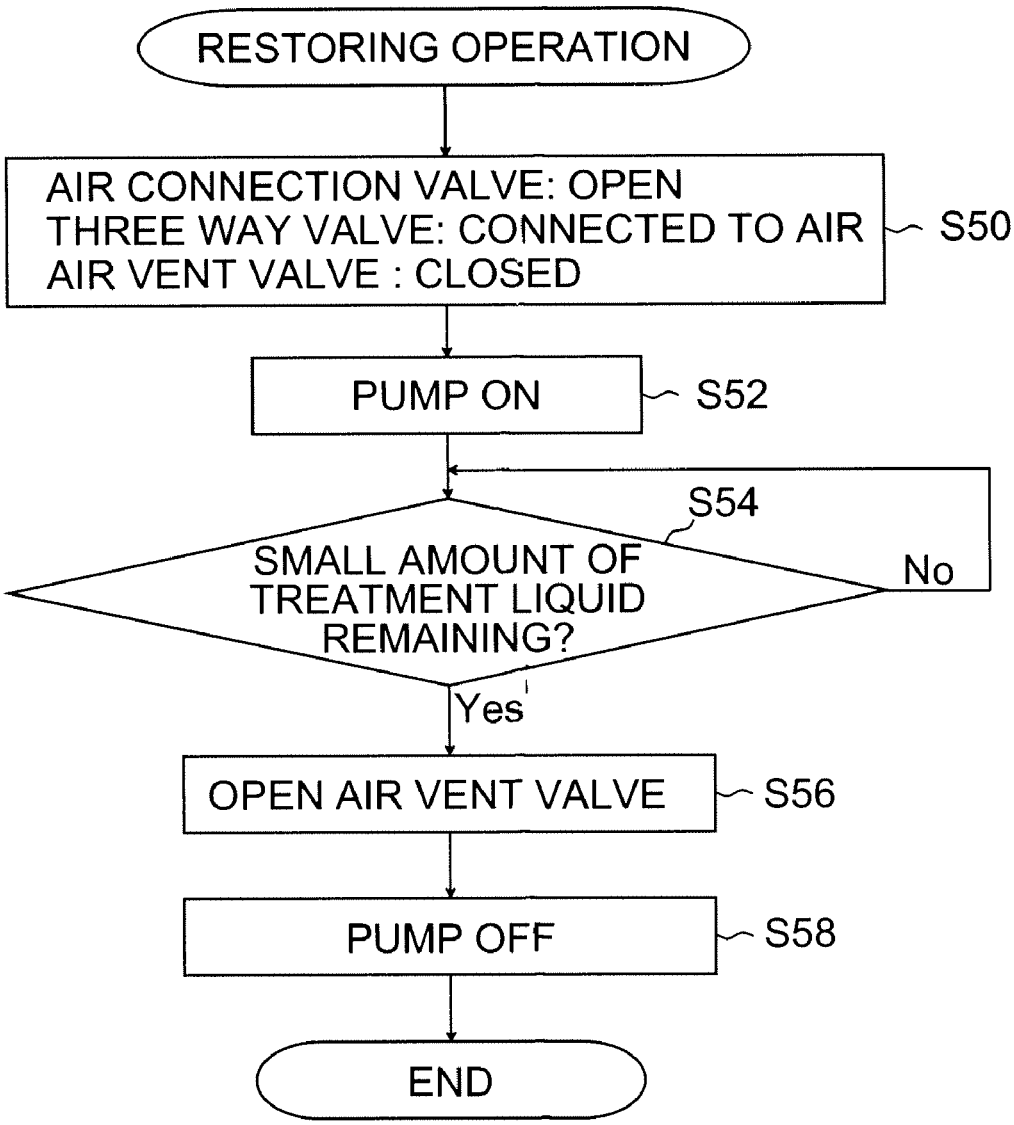
FIG. 9 is a flowchart illustrating the details of a return operation (restoring operation)

Here, the return operation (restoring operation) is described in detail with reference to FIG. 9. FIG. 9 is a flowchart illustrating the details of a return operation. In this return operation, firstly, the air connection valve 114 of the storage tank 110 is opened, and the three way valve 122 is switched to set the supply flow channel 120 to an air connected state (a state where the liquid holding member side flow channel 120*b* and the air connection port 124 are connected), and furthermore the air vent valve 134 is set to a closed state (step S50). Thereupon, the driving of the pump 132 is started (switched on) (step S52). By this means, the treatment liquid in the liquid holding space S is sent to the storage tank 110, and the air taken in via the air connection port 124 is filled into the respective sections.

In this case, since the air vent valve 134 of the gas expulsion flow channel 136 is in a closed state, then the treatment liquid which has been sent to the storage tank 110 is expelled into the treatment liquid layer via the return flow channel 130.

Next, the end timing of the return operation is judged (step S54). The judgment at step S54 is No until the end timing of the return operation, and the driving of the pump 132 is continued. When the end timing of the filling operation is reached, the judgment in step S44 becomes Yes, the air vent valve 134 is opened (step S56), and the driving of the pump 132 is halted (switched off) (step S58).

Here, the end timing of the return operation uses a timing slightly before the return of all of the treatment liquid present in the path from the liquid holding member side flow channel 120*b* of the supply flow channel 120 including the liquid holding space S to the return flow channel 130 (hereinafter, this path is called "liquid path A").

At the stage immediately before the end of the return operation, the air that has been taken in from the air connection port 124 is sent to the storage tank 110 together with the treatment liquid, and therefore by opening the air vent valve 134 at a timing slightly before all of the treatment liquid present in the liquid path A has been returned, the air is expelled from the opening section 136*a* of the gas expulsion flow channel 136 to the gas layer of the storage tank 110, while at the same time the treatment liquid can be expelled into the liquid layer of the storage tank 110 from the opening section 130*a* of the return flow channel 130.

In this way, the treatment liquid inside the liquid path A is returned into the storage tank 110 and the liquid path A becomes filled with air.

In the present embodiment, a desirable mode is one in which a timer device that counts the drive time of the pump 132 is provided, and the end timing of the return operation is judged on the basis of time management using the timer device. For example, the timing lo at which air starts to be expelled from the opening section 130*a* of the return flow channel 130 in a state where the air vent valve 134 is closed is either calculated from the volume of the liquid path A and the capacity of the pump 132, or is determined in advance experimentally, and the air vent valve 134 is opened at this timing. According to the present embodiment of the invention, it is possible to return completely the treatment liquid present in the liquid path A, without expelling air into the liquid layer of the storage tank 110.

Furthermore, in a further mode, it is possible to open the air vent valve 134 at a stage slightly after all of the treatment liquid present in the liquid path A has been returned. In this mode, air is expelled momentarily into the treatment liquid layer in the storage tank 110, but provided that this occurs for a short period of time, it has little effect and the extent of oxidation of the treatment liquid does not pose a problem.

After the return operation, the air connection valve 114 is closed, the three way valve 122 is switched so as to set the liquid holding member side flow channel 120*b* and the air connection port 124 to a connected state, and the storage tank 110 is shut off from the air, thereby preventing evaporation and outflow of liquid.

As described above, according to the present embodiment, since the gas expulsion flow channel 136 branches to the return flow channel 130 for returning the treatment liquid in the liquid holding space S to the storage tank 110, and since the opening section 136*a* of the gas expulsion flow channel 136 is disposed at a position above the surface L of the treatment liquid, in addition to which an air vent valve 134 is provided in the gas expulsion flow channel 136, then in the operations of filling treatment liquid and returning treatment liquid to and from the liquid holding space S, air bubbles are expelled into the gas layer of the storage tank 110, without being agitated and mixed into the liquid in the treatment liquid layer in the storage tank 110, and therefore it is possible to prevent oxidation of the treatment liquid inside the storage tank 110. Consequently, it is possible to cause the ink to aggregate sufficiently by reaction with the treatment liquid, thus preventing bleeding and color mixing of the inks, and therefore improvement in image quality can be achieved.

Further Compositional Example

Figure 10:
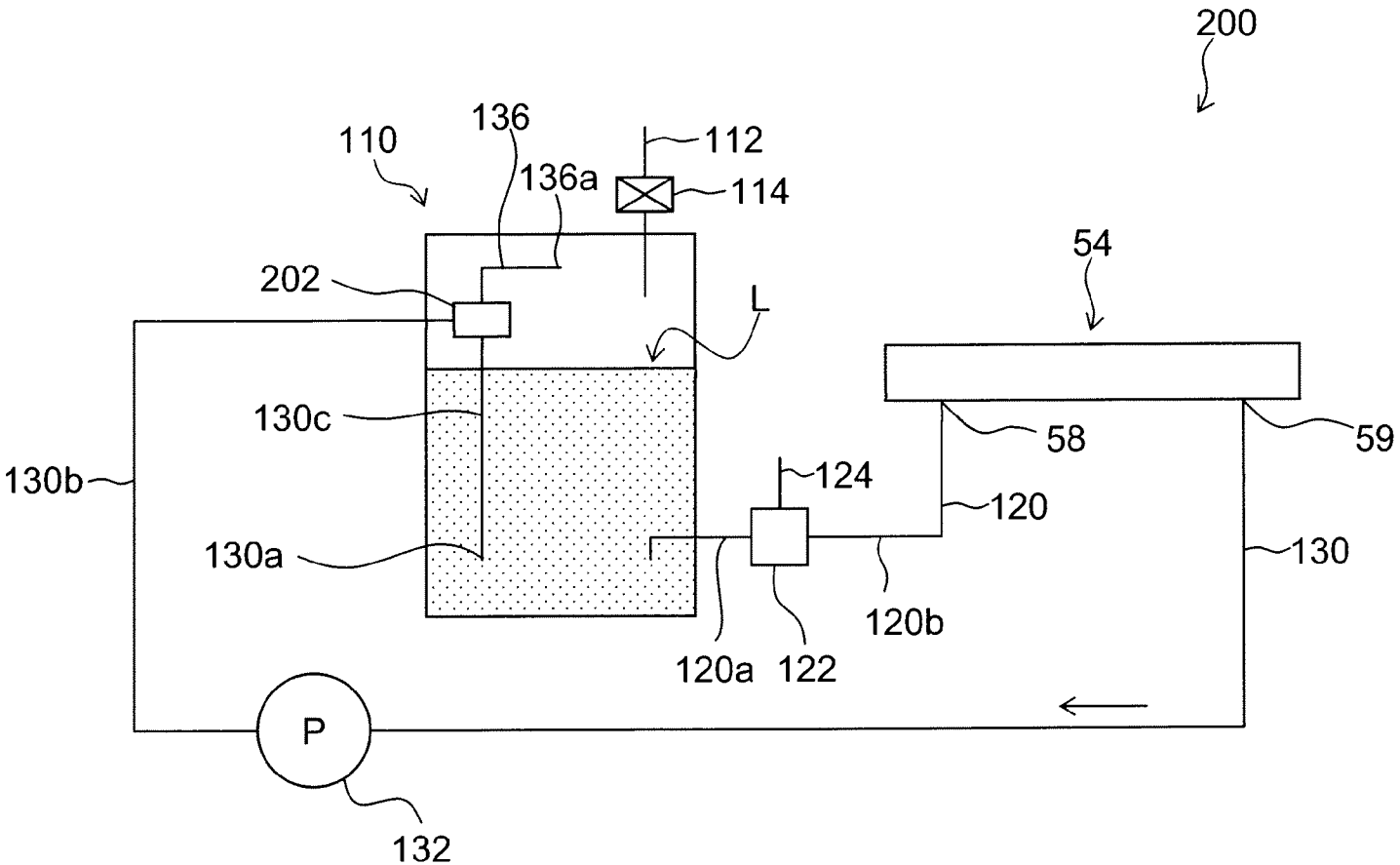
FIG. 10 is a schematic drawing illustrating a further example of the composition of a liquid supply apparatus which is connected to the liquid holding member.

FIG. 10 is a schematic drawing illustrating a further example of the composition of a liquid supply apparatus which is connected to the liquid holding member 54. In FIG. 10, parts which are the same as those in FIG. 4 are assigned with the same reference numbers, and further description thereof is omitted here.

In the liquid supply apparatus 200 illustrated in FIG. 10, a three way valve 202 is provided in the return flow channel 130. This three way valve 202 has a similar composition to the three way valve 122 provided in the supply flow channel 120. In other words, the three way valve 202 has three ports which are mutually connected, and two of these ports can be connected selectively to any two of the liquid holding member side flow channel 130*b* in the supply flow channel 130, the storage tank side flow channel 130*c*, and the air expulsion flow channel 136. The air expulsion flow channel 136 is not provided with an air vent valve 134 illustrated in FIG. 4. By switching this three way valve 202, it is possible to switch selectively between a connected state where the liquid holding member side flow channel 130*b* and the storage tank side flow channel 130*c* are connected, and a connected state where the liquid holding member side flow channel 130*b* and the gas expulsion flow channel 136 are connected. The switching of the three way valve 202 is controlled by the control unit 60 illustrated in FIG. 5.

This three way valve 202 may be controlled at the same timing as the air vent valve 134 illustrated in FIG. 4. For example, in the filling operation illustrated in FIG. 7, at step S40, instead of opening the air vent valve 134, the three way valve 202 is switched and the liquid holding member side flow channel 130*b* and the gas expulsion flow channel 136 are set to a mutually connected state. At step S46, instead of closing the air vent valve 134, the three way valve 202 may be switched to set the liquid holding member side flow channel 130*b* and the storage tank side flow channel 130*c* to a mutually connected state. The same applies to the return operation illustrated in FIG. 9.

In a mode where the switching of the three way valve 202 provided in the return flow channel 130 is controlled, it is possible to prevent oxidation of the treatment liquid in the storage tank 110, similarly to the mode described with reference to FIG. 1 to FIG. 9.

The embodiments described above relates to an example of application to an inkjet recording apparatus for printing, but the scope of application of the present invention is not limited to the embodiments. For instance, it can also be applied widely to other apparatuses which obtain various shapes and patterns by using a liquid functional material, such as a wiring printing apparatus which prints a wiring pattern for an electronic circuit, and a fine structure forming apparatus which forms a fine structure by using a material deposition substance.

It should be understood that there is no intention to limit the invention to the specific to forms disclosed, but on the contrary, the invention is to cover all modifications, alternate constructions and equivalents falling within the spirit and scope of the invention as expressed in the appended claims.

What is claimed is:

1. An image forming apparatus comprising:

a treatment liquid application device which applies a treatment liquid to a recording medium;

a treatment liquid supplying device which abuts against the treatment liquid application device so as to form a liquid holding space, fills the treatment liquid into the liquid holding space by use of a liquid delivery device which delivers the treatment liquid to the liquid holding space via a first flow channel from a treatment liquid reservoir storing the treatment liquid, and restores the treatment liquid to the treatment liquid reservoir via a second flow channel from the liquid holding space;

a controller which controls at least one of a treatment liquid filling operation and a treatment liquid restoring operation with respect to the liquid holding space;

an ink ejecting device which ejects a droplet of an ink onto the recording medium to which the treatment liquid application device has applied the treatment liquid; and an air bubble mixing avoidance device which is provided in the second flow channel and prevents air from discharging in the treatment liquid in the treatment liquid reservoir.

2. The image forming apparatus as defined in claim 1, wherein:

the treatment liquid reservoir has an air connection port formed with an air connection valve;

the first flow channel is formed with a three way valve which enables the first flow channel to be open to air;

the second flow channel has an opening situated below a surface of the treatment liquid in the treatment liquid reservoir; and the air bubble mixing avoidance device has a third flow channel which branches off from the second flow channel, an air vent valve which is capable of opening and closing the third flow channel, and an opening situated above the surface of the treatment liquid in the treatment liquid reservoir.

3. The image forming apparatus as defined in claim 2, wherein, when filling the treatment liquid into the liquid holding space, the controller switches the air vent valve from an open condition to a closed condition at a first timing.

4. The image forming apparatus as defined in claim 3, wherein the first timing is set according to volume of the liquid holding space, volume of the first flow channel, volume of the second flow channel and performance of the liquid delivery device.

5. The image forming apparatus as defined in claim 2, wherein, when restoring the treatment liquid from the liquid holding space, the controller switches the air vent valve from a closed condition to an open condition at a second timing.

6. The image forming apparatus as defined in claim 5, wherein the second timing is set according to volume of the liquid holding space, volume of a portion of the first flow channel which is closer to the liquid holding space than the three way valve, volume of the second flow channel and performance of the liquid delivery device.

* * * * *